US011365731B2

(12) United States Patent
Einfalt

(10) Patent No.: US 11,365,731 B2
(45) Date of Patent: Jun. 21, 2022

(54) COMPACT DUAL-SECTION GEAR PUMP

(71) Applicant: Parker-Hannifin Corporation, Cleveland, OH (US)

(72) Inventor: John B. Einfalt, Girard, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 42 days.

(21) Appl. No.: 16/844,156

(22) Filed: Apr. 9, 2020

(65) Prior Publication Data

US 2020/0362860 A1 Nov. 19, 2020

Related U.S. Application Data

(60) Provisional application No. 62/846,939, filed on May 13, 2019.

(51) Int. Cl.

| | |
|---|---|
| ***F04C 11/00*** | (2006.01) |
| ***F04C 2/08*** | (2006.01) |
| ***F04C 15/00*** | (2006.01) |
| ***F04C 2/18*** | (2006.01) |

(52) U.S. Cl.

CPC ..... *F04C 11/001* (2013.01); *F04C 2/084* (2013.01); *F04C 2/086* (2013.01); *F04C 2/18* (2013.01); *F04C 15/0026* (2013.01); *F04C 2240/20* (2013.01); *F04C 2240/56* (2013.01); *F04C 2250/101* (2013.01); *F04C 2250/30* (2013.01)

(58) Field of Classification Search

CPC ..... F04C 11/001; F04C 15/0026; F04C 2240/20; F04C 2240/56; F04C 2250/101; F04C 2250/30; F04C 2/084; F04C 2/086; F04C 2/18

See application file for complete search history.

(56) References Cited

U.S. PATENT DOCUMENTS

| | | | | |
|---|---|---|---|---|
| 2,412,588 A * | 12/1946 | Lauck | F04C 14/265 418/135 |
| 3,922,117 A * | 11/1975 | Weatherston | F04C 23/001 418/9 |
| 5,466,131 A | 11/1995 | Altham | |
| 6,729,855 B2 | 5/2004 | Havlik | |

(Continued)

FOREIGN PATENT DOCUMENTS

| | | |
|---|---|---|
| DE | 102015121311 A1 | 6/2017 |
| KR | 20180079574 A | 7/2018 |

*Primary Examiner* — Mary Davis

(74) *Attorney, Agent, or Firm* — Renner, Otto, Boisselle & Sklar, LLP

(57) ABSTRACT

A dual-section gear pump that enhances compactness of the design includes two pump sections separated by a divider. Each pump section includes a pump cavity and a gear set configured to convey fluid from an intake side to a discharge side of the respective pump cavities. The divider includes a fluid flow passage that enables the two pump sections to share common intake flow via the flow passage provided across the divider. The divider also is configured to enable each gear set in each pump section to provide independent pressurization of the fluid in each pump section, which is discharged from each pump cavity via separate outlets. The gear pump is configured to provide suitable sealing between each pump section and support of the respective gear sets in each pump section while enhancing compactness of the design.

20 Claims, 13 Drawing Sheets

(56) References Cited

U.S. PATENT DOCUMENTS

| | | | | |
|---|---|---|---|---|
| 7,037,085 | B1 | 5/2006 | Stark | |
| 9,611,847 | B2 * | 4/2017 | Martin-Dye | F04C 15/0026 |
| 10,174,759 | B2 | 1/2019 | Kim | |

* cited by examiner

COMPACT DUAL-SECTION GEAR PUMP

RELATED APPLICATIONS

This application claims the benefit of U.S. Provisional Application No. 62/846,939 filed May 13, 2019, which is hereby incorporated herein by reference.

FIELD OF INVENTION

The present invention relates generally to gear pumps, and more particularly to a compact dual-section gear pump of an external-type.

BACKGROUND

A gear pump is a type of fixed displacement pump that moves fluid using a set of interlocking meshed gears disposed within a cavity of the pump. Typical external-type gear pumps generally include one gear that is driven by a motor via a drive shaft, which thereby drives the other gear disposed on a separate shaft via the interlocking engagement between gear teeth of each gear. As the gears rotate, the respective gear teeth separate on an intake side of the pump cavity, which creates an expanding volume and suction that is filled by fluid that enters the pump via an inlet. As the gear teeth of each gear continue to rotate, the fluid is trapped against the inside of the pump casing in the spacing between the gear teeth of each gear, thus moving the trapped fluid around the inside of the casing from the intake side to the discharge side of the pump cavity. As the teeth of the gears become interlocked on the discharge side of the pump, the volume is reduced and the fluid is forced out through an outlet of the pump under pressure.

SUMMARY OF INVENTION

The present invention provides a dual-section gear pump that enhances compactness of the design while also providing efficiency at a competitive cost.

More particularly, the gear pump provides at least two pump sections separated by a divider, in which the two pump sections may share a common intake flow across the divider, and also provides respective gear sets in each pump section for providing independent pressurization of the fluid in each pump section for discharge of the pressurized fluid via separate outlets of the pump.

According to an aspect of the invention, a gear pump includes: a first pump section, a second pump section, and a divider that separates the first pump section from the second pump section; the first pump section having: a first pump cavity having a first intake side and a first discharge side, an inlet fluidly connected to the first intake side of the first pump cavity for ingress of fluid into the first pump cavity, a first gear set disposed in the first pump cavity and separating the first intake side from the first discharge side, the first gear set including a first drive gear and a first idler gear that are rotatable about respective axes, wherein the first drive gear and the first idler gear are configured to be in meshing engagement with each other such that fluid is transferred around the outside of the first gear set from the first intake side to the first discharge side when in use; and a first outlet in fluid communication with the first discharge side of the first pump cavity for enabling discharge of the fluid from the first pump cavity; the second pump section having: a second pump cavity having a second intake side and a second discharge side, a second gear set disposed in the second pump cavity and separating the second intake side from second first discharge side, the second gear set including a second drive gear and a second idler gear that are rotatable about respective axes, wherein the second drive gear and the second idler gear are configured to be in meshing engagement with each other such that fluid is transferred around the outside of the second gear set from the second intake side to the second discharge side when in use; and a second outlet in fluid communication with the second discharge side of the second pump cavity for enabling discharge of the fluid from the second pump cavity; wherein the divider includes a fluid flow passage that fluidly connects the first pump cavity with the second pump cavity for supplying fluid to the second intake side of the second pump cavity.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
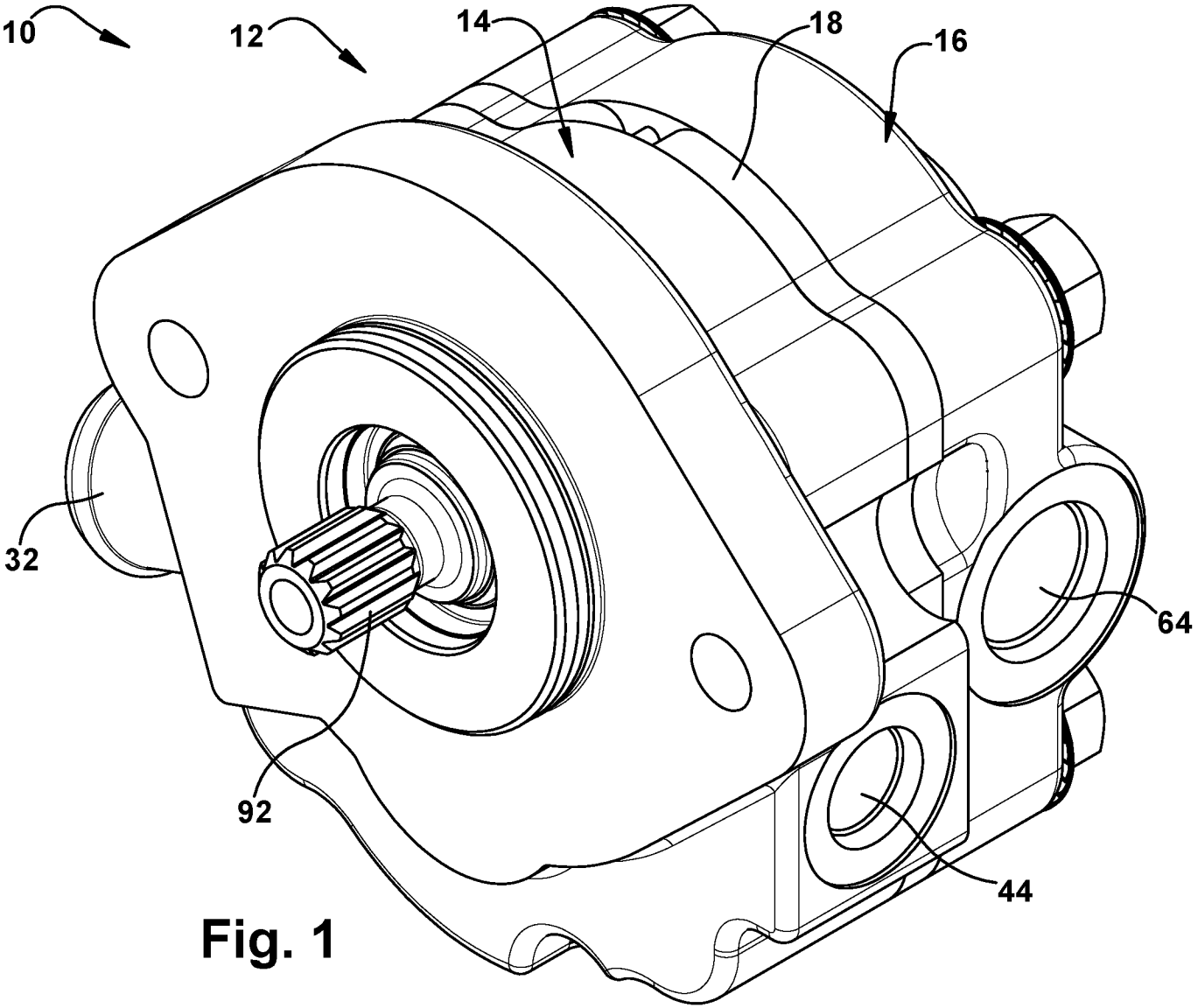
FIG. 1 is a front perspective view of an exemplary gear pump according to an embodiment of the invention.
Figure 2:
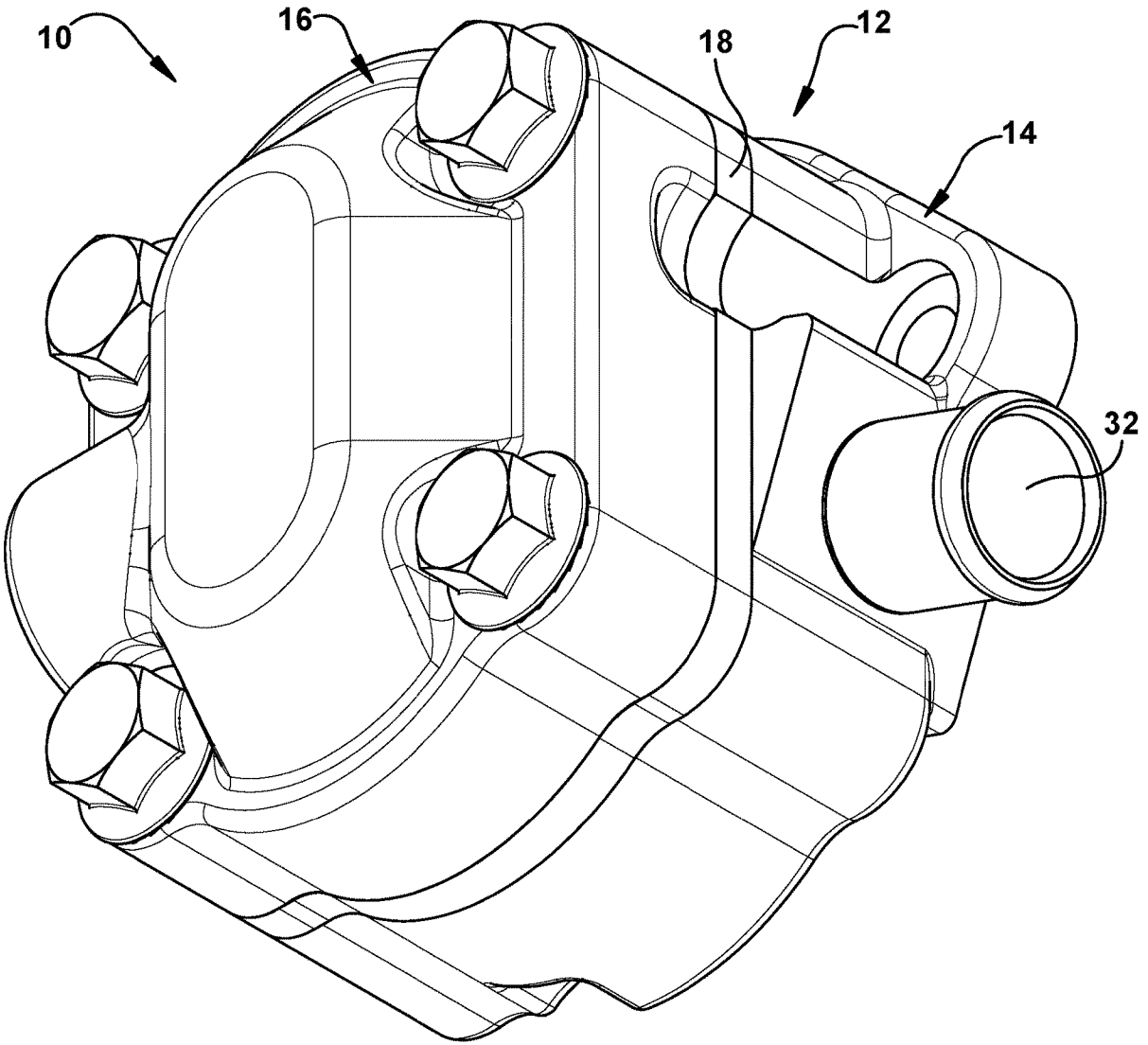
FIG. 2 a rear perspective view of the gear pump.
Figure 4:
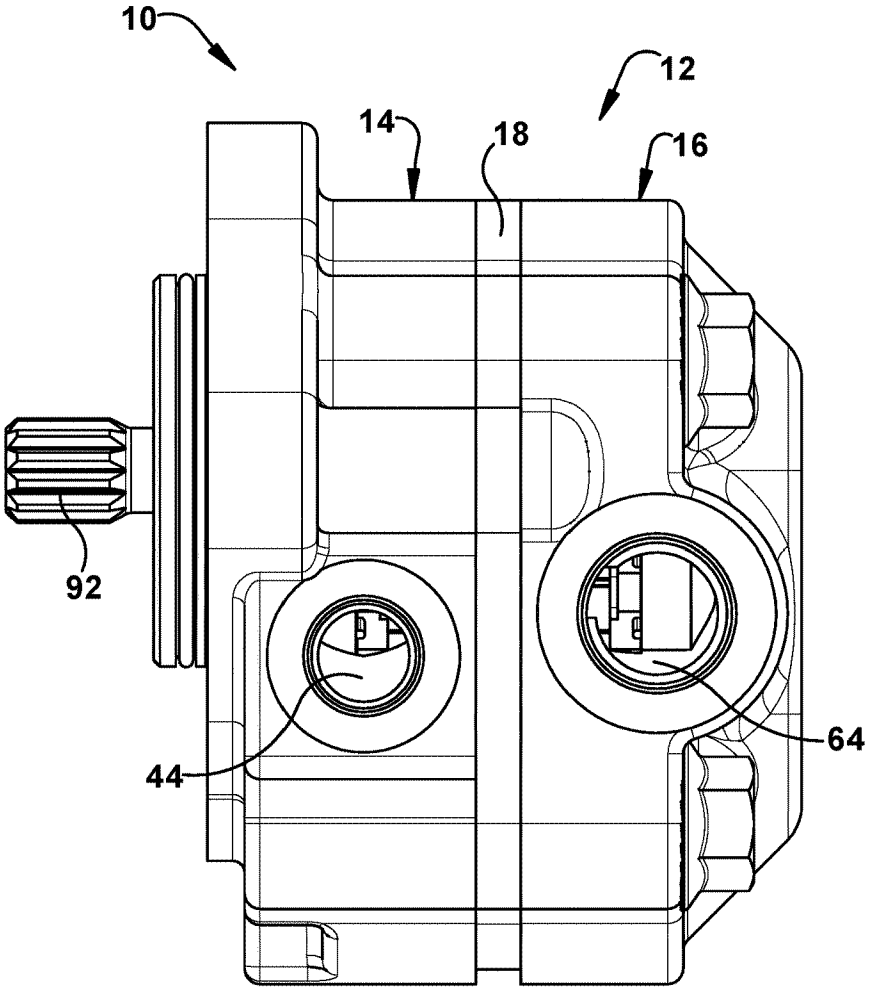
FIG. 4 is a right side plan view of the gear pump.
Figure 3:
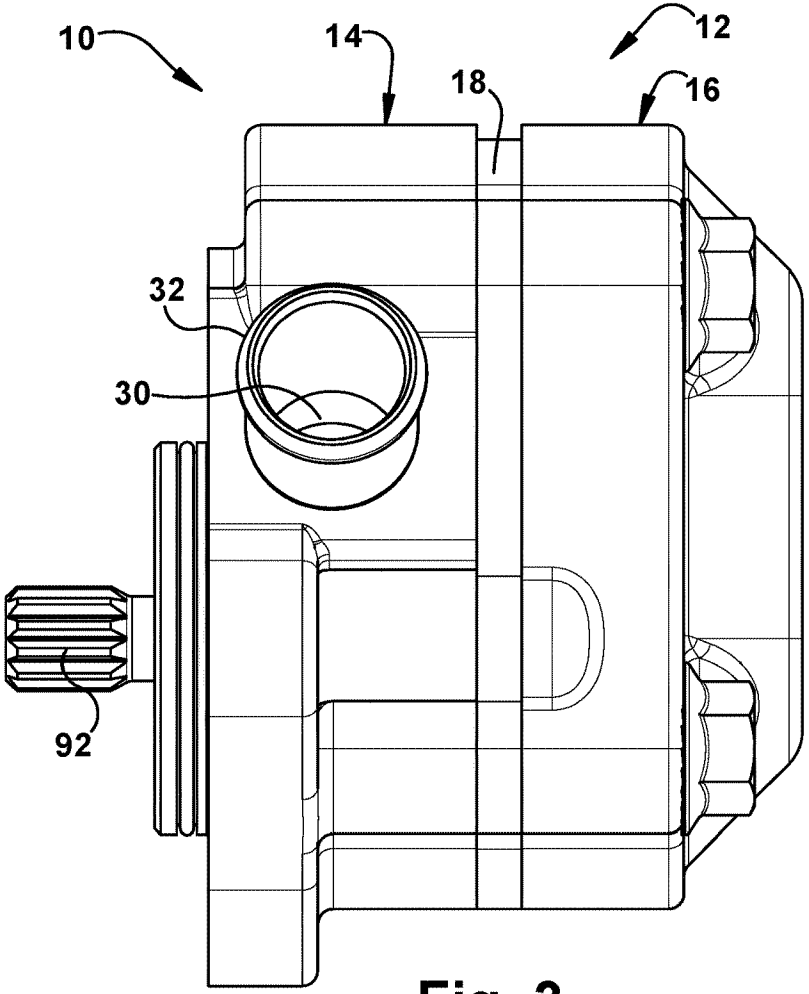
FIG. 3 a left side plan view of the gear pump.
Figure 6:
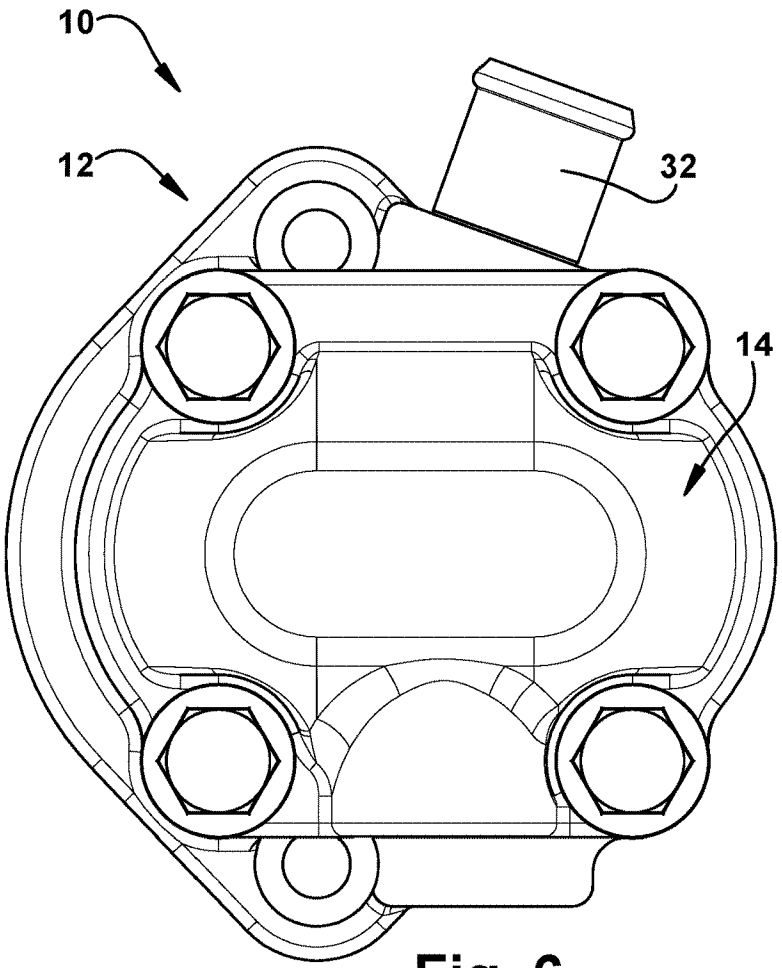
FIG. 6 is a rear plan view of the gear pump.
Figure 5:
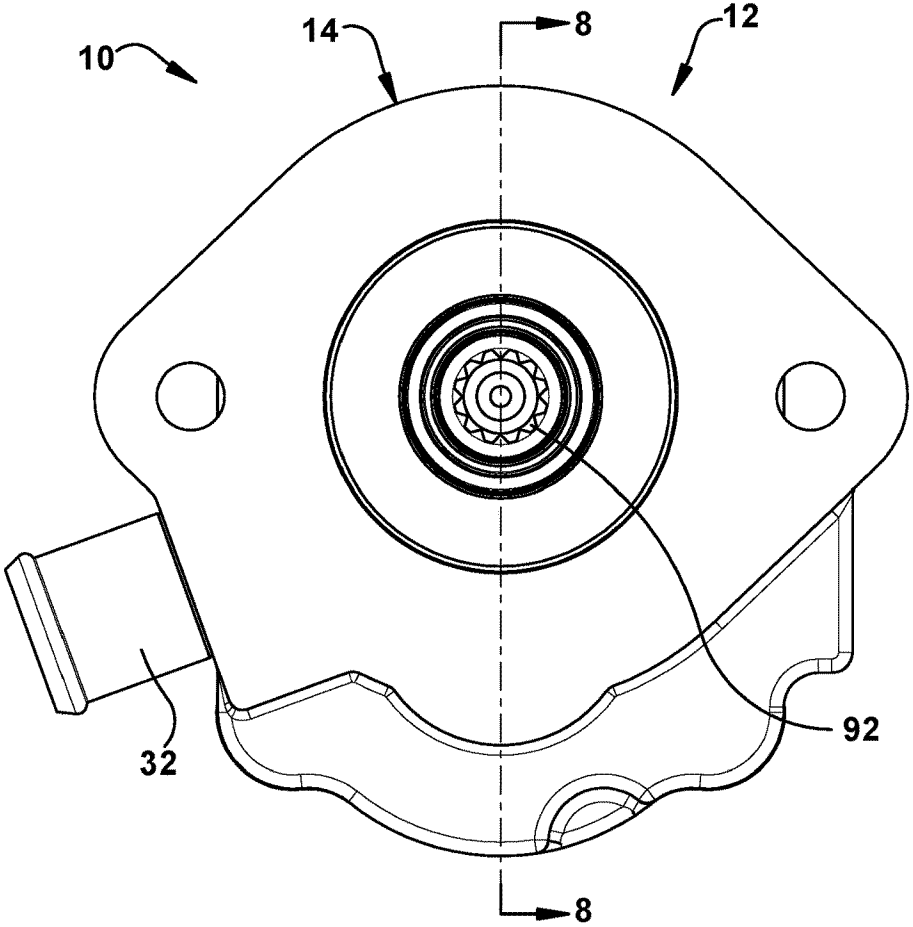
FIG. 5 is a front plan view of the gear pump.

The principles and aspects of the present invention have particular application to compact external-type gear pumps, such as for use in agricultural vehicles or other suitable work machines for controlling one or more primary and/or auxiliary functions of the machine, and thus will be described below chiefly in this context. It understood, however, that the principles and aspects of this invention may be applicable to other hydraulic systems for other applications where it is desirable to provide a cost-effective, efficient, and compact dual-section pump.

FIGS. 1-15 show an exemplary dual-section gear pump 10, or portions thereof, according to an embodiment of the invention. Generally, the gear pump 10 includes a dual-section housing 12, or casing, that is at least partially formed by a first pump section 14, a second pump section 16, and a divider 18 that separates the first pump section 14 from the second pump section 16.

Figure 10:
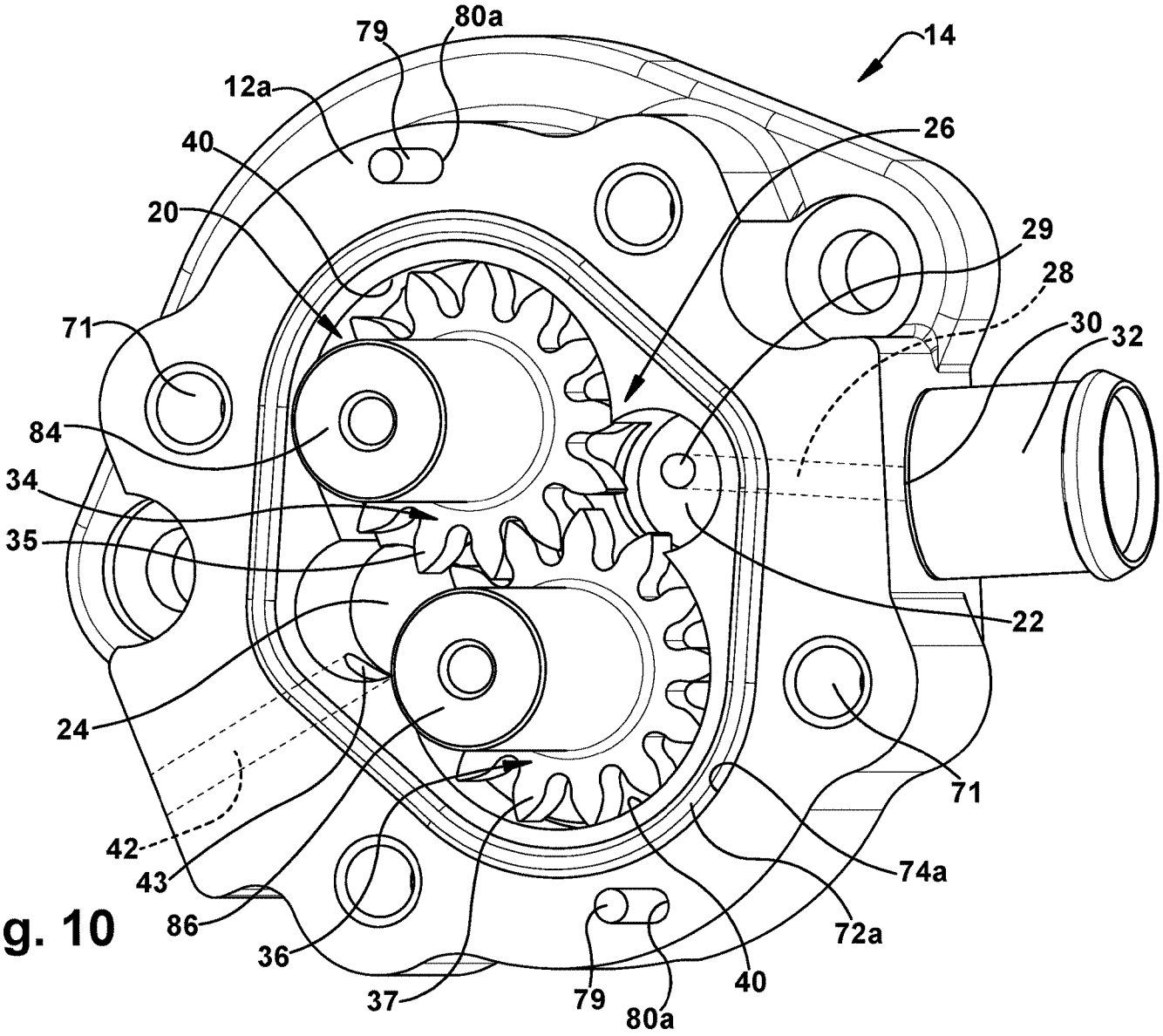
FIG. 10 is a perspective view of an exemplary first pump section of the gear pump, including an exemplary first gear set.
Figure 11:
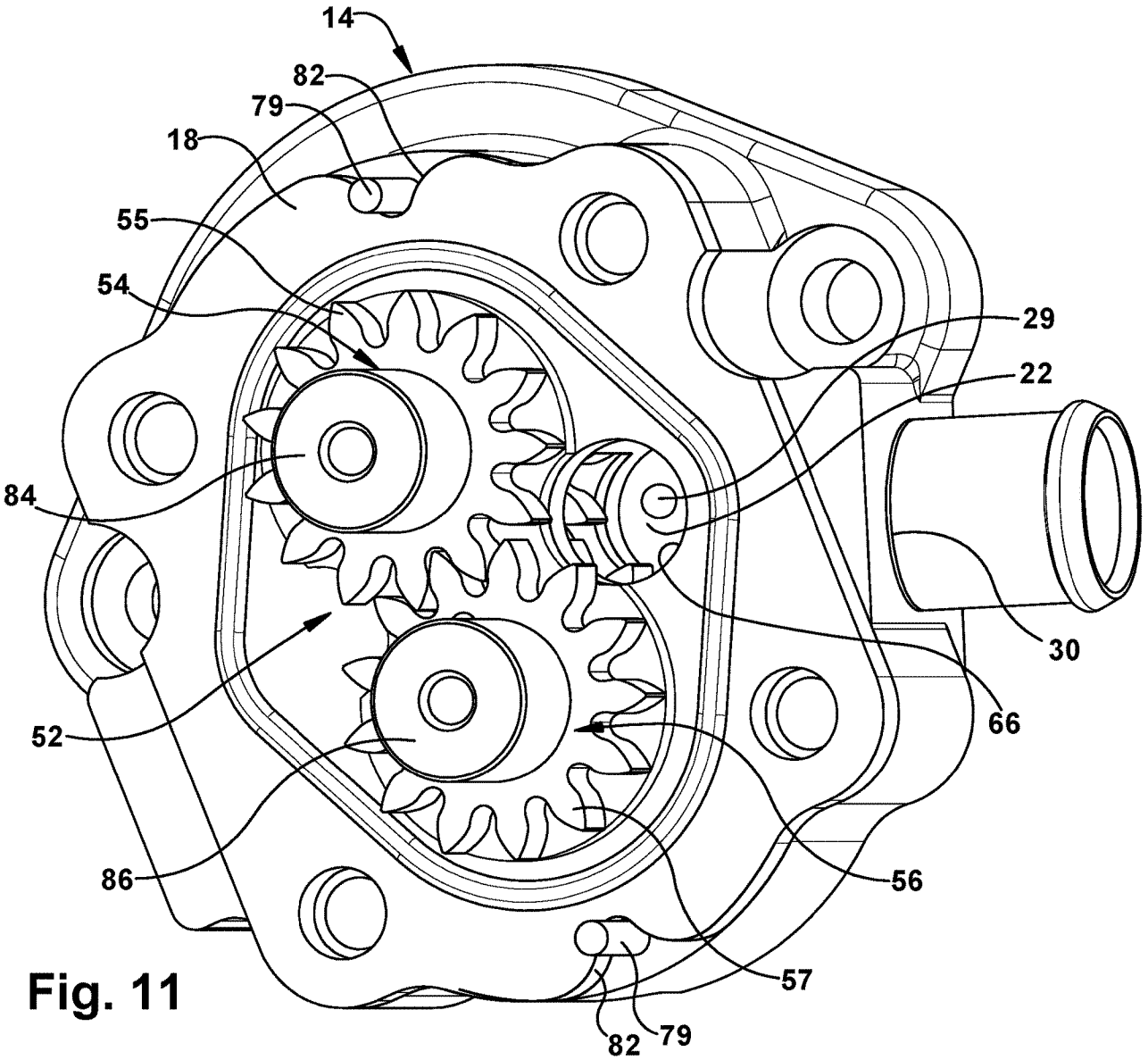
FIG. 11 is a perspective view of the exemplary first pump section shown in FIG. 10 and also showing an exemplary divider and an exemplary second gear set.
Figure 12:
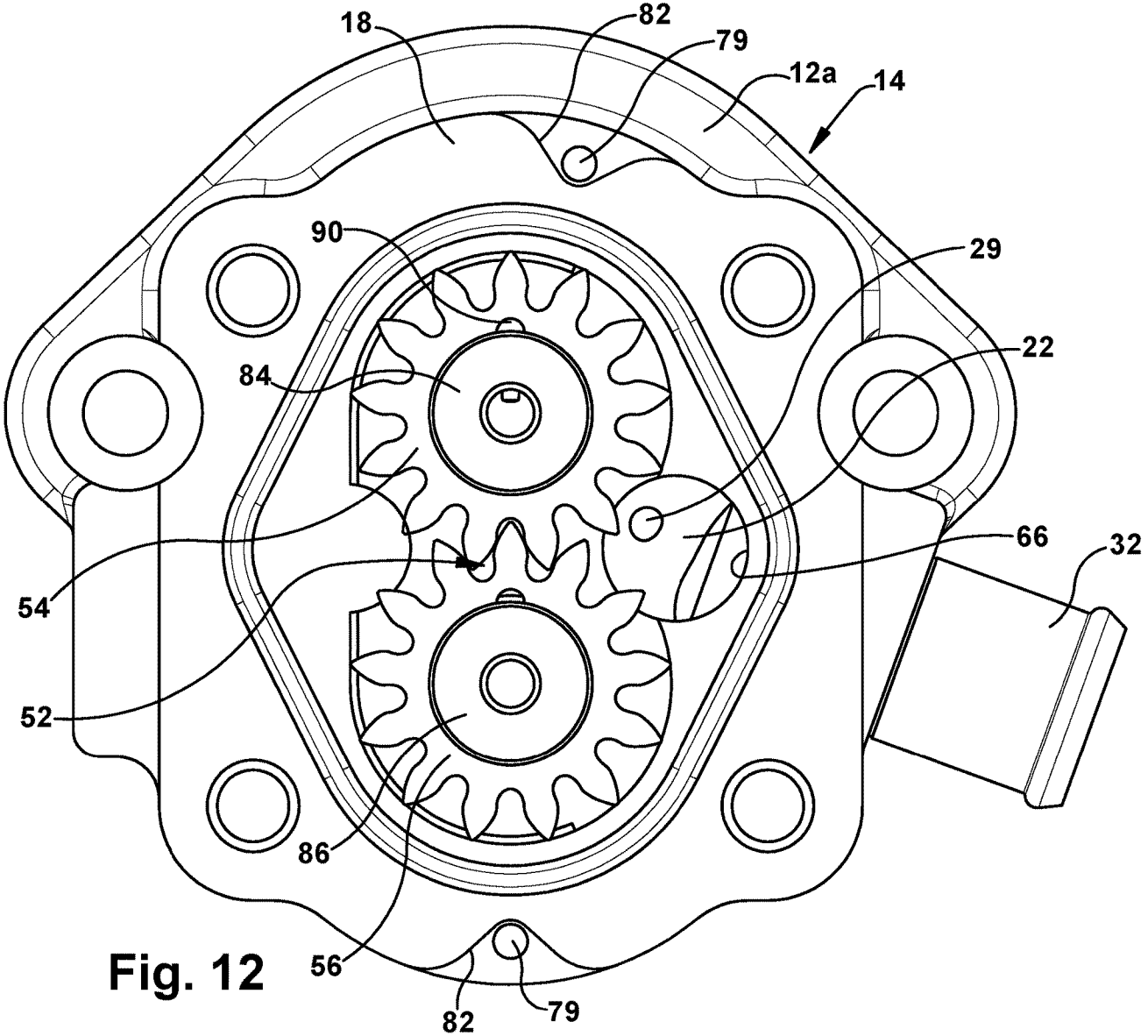
FIG. 12 is a rear plan view of the components shown in FIG. 11.

The first pump section 14 generally includes a first pump cavity 20 having a first intake side 22 and a first discharge side 24 (as best shown in FIG. 10, for example). A first gear set 26 is disposed in the first pump cavity 20 and separates the first intake side 22 from the first discharge side 24. An inlet 28 extends through the pump housing 12 and opens outwardly of the pump housing 12 via an inlet port 30 for fluid connection to a fluid source, such as a reservoir (shown in FIG. 16), via a pipe 32 or other suitable conduit connected to the inlet port 30 and/or pipe 32. The inlet 28 also opens inwardly to the first pump cavity 20 via an inlet opening 29 to fluidly connect with the first intake side 22 of the first pump cavity for ingress of fluid into the first pump cavity 20.

Figure 8:
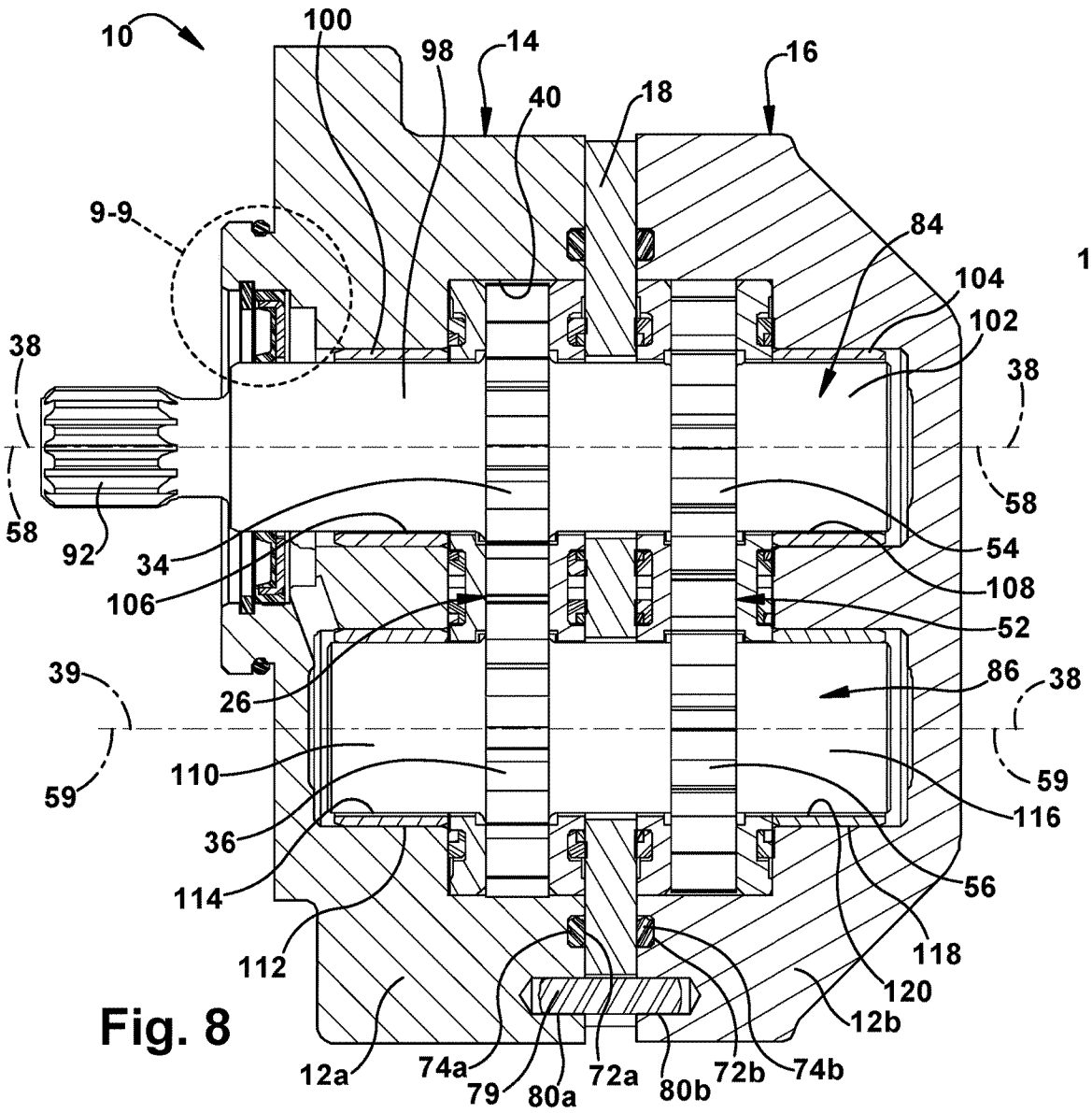
FIG. 8 is a cross-sectional side view of the gear pump taken about the line 8-8 in FIG. 5.

As shown in the illustrated embodiment, the first gear set 26 is of the external gear type, and generally includes a first drive gear 34 and a first idler gear 36, each having respective gear teeth 35, 37 that are in meshing engagement with each other. As best shown in FIGS. 8 and 10, for example, the first gear set 26 is arranged within the first pump cavity 20 to allow the gears 34, 36 to freely rotate about their respective axes 38, 39 (e.g., in opposite directions), while also providing close tolerance of the respective gear teeth 35, 37 with the internal surface 40 that defines the pump cavity 20. As the gears 34, 36 rotate, the respective gear teeth 35, 37 separate on the intake side 22 of the first pump cavity 20, which creates an expanding volume and suction that is filled by the fluid that enters the first pump cavity 20 via the inlet 28. As the gear teeth 35, 37 of each gear 34, 36 continue to rotate close to or against the internal surface 40 of the pump cavity 20, the fluid is trapped in the spacing between the gear teeth 35, 37 of each gear 34, 36 and against the internal surface 40 of the pump cavity 20, thus moving the trapped fluid around the outside of each gear 34, 36 from the first intake side 22 to the first discharge side 24 of the first pump cavity 20.

As the respective teeth 35, 37 of the first gear set 26 become interlocked on the discharge side 24, the volume is reduced and the fluid is forced out under pressure through a first outlet 42 of the first pump section. Fluid is restricted from transferring back through the center of the first gear set 26 between the gears 34, 36 due to the meshed interlocked engagement of the teeth 35, 37. Close tolerances between the gears 34, 36 and the internal surface 40 of the first pump cavity 20 allow the pump 10 to develop suction at the intake side 22 and also restricts fluid from leaking back from the discharge side 24. As shown, the first outlet 42 extends through the pump housing 12 to open inwardly to the first pump cavity 20 via an outlet opening 43 to fluidly connect with the discharge side 24 of the first pump cavity 20, and also opens outwardly of the pump housing 12 via a first outlet port 44 (see e.g., FIGS. 4 and 7) to allow discharge of the pressurized fluid from the first pump cavity 20. The first outlet port 44 may include threads (or any other suitable connector) for connection to a fluid conduit (or any other suitable fluid passage) which may convey the fluid downstream for providing a hydraulic function (or other suitable work function) to a work machine, for example.

Figure 7:
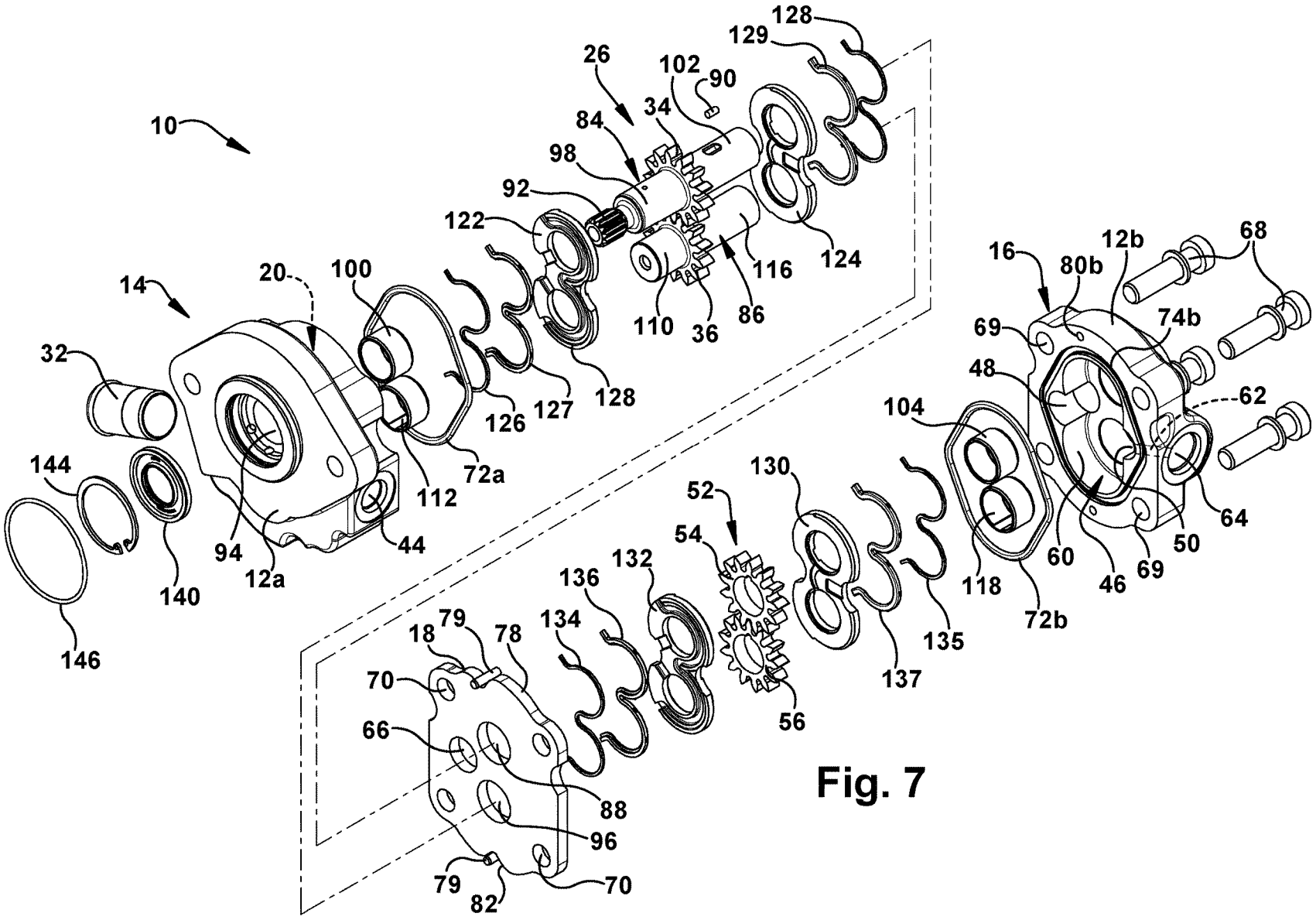
FIG. 7 is an exploded perspective view of the gear pump.
Figure 9:
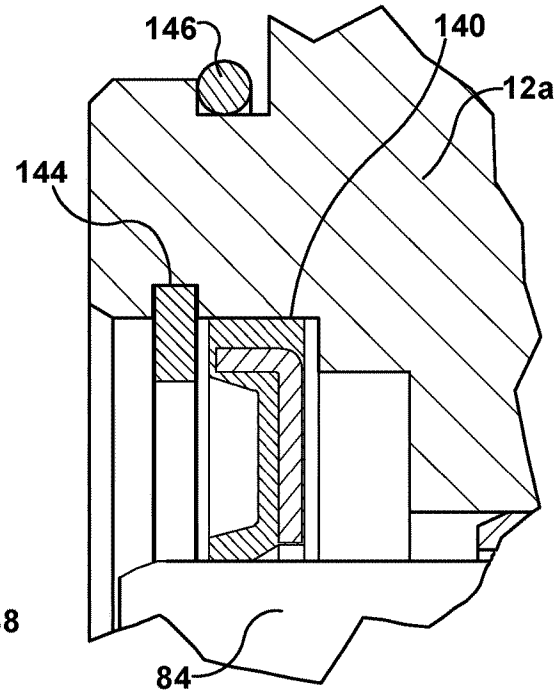
FIG. 9 is an enlarged cross-sectional side view taken from section 9-9 in FIG. 8.

The second pump section 16 is generally constructed the same as the first pump section 14. As shown, similarly to the first pump section 14, the second pump section 16 includes a second pump cavity 46 having a second intake side 48 and a second discharge side 50 (as best shown in FIG. 7, for example). A second gear set 52 is disposed in the second pump cavity 46 and separates the second intake side 48 from the second discharge side 50. Similarly to the first gear set 26, the second gear set 52 is of the external gear type, and generally includes a second drive gear 54 and a second idler gear 56, each having respective gear teeth 55, 57 that are in meshing engagement with each other. Similarly to the first gear set 26, the second gear set 52 is arranged within the second pump cavity 46 to allow the gears 54, 56 to freely rotate about their respective axes 58, 59 (e.g., in opposite directions), while also providing close tolerance of the gear teeth 55, 57 with the internal surface 60 that defines the second pump cavity 46. This allows the second gear 52 set to generate suction at the second intake side 48, move the trapped fluid around the outside of the second gear set 52 to the discharge side 50, whereby fluid pressure is increased and discharged through a second outlet 62 (see e.g., FIGS. 7 and 15) of the second pump section 16.

Also similarly to the first pump section 14, the second outlet 62 of the second pump section 16 extends through the pump housing 12 to open inwardly to the second pump cavity 46 via a second outlet opening 63 (hidden from view) to fluidly connect with the discharge side 50 of the second pump cavity 46. The second outlet 62 also opens outwardly of the pump housing 12 via a second outlet port 64 (see e.g., FIGS. 7 and 15) to allow discharge of the pressurized fluid from the second pump cavity 46. The second outlet port 64 may include threads (or any other suitable connector) for connection to a fluid conduit (or any other suitable fluid passage) which may convey the fluid downstream for providing a hydraulic function (or other suitable work function) to a work machine, as discussed in further detail below. Also as discussed in further detail below, such functionality of the dual-section gear pump 10, having two separate and independently pressurized fluid discharge sides 24, 50, enables the gear pump 10 to supply fluid pressure to two independent work functions of a work machine. This enables the gear pump 10 to operate efficiently, especially if there is a large difference in the loading between the two separate work functions.

The divider 18 generally separates the first pump section 14 from the second pump section 16. More particularly, the divider 18 is configured to separate the respective pump sections 14, 16 such that each pump section 14, 16 may provide independent pressurization and discharge of the fluid in each pump section 14, 16. More particularly, the divider 18 generally is configured to help sealingly isolate the fluid in the respective discharge sides 24, 50 of each pump cavity 20, 46 to provide such independent pressurization in the respective first and second pump sections 14, 16, and also to enable such independent discharge of the pressurized fluid via the separate first and second outlets ports 44, 64.

In exemplary embodiments, the divider 18 also enables fluid communication between the respective first and second intake sides 22, 48 of the respective first and second pump cavities 20, 46. For example, as shown in the illustrated embodiment, the divider 18 includes a fluid flow passage 66, such as a through-hole, that fluidly connects the intake side 22 of the first pump cavity 20 with the intake side 48 of the second pump cavity 46. This enables the gear pump to utilize a single inlet 28, if desired, for supplying flow to both pump sections 14, 16 by sharing intake flow between the respective first and second intake sections 22, 48 via the flow passage 66 extending across the divider 18. Such a configuration may help to enhance the compactness of the gear pump design while also minimizing manufacturing costs.

In exemplary embodiments, the fluid flow passage 66 of the divider 18 is sized sufficiently large enough to minimize pressure drop across the fluid passage 66 as fluid is supplied from the intake side 22 of the first pump cavity 20 to the intake side 48 of the second pump cavity 46. For example, the fluid flow passage 66 in the divider 18 may have an opening diameter that is about the same size as a diameter of the first and/or second intake sides 22, 48 of the respective first and second pump cavities 20, 46. In the illustrated embodiment, for example, the fluid flow passage 66 has an opening diameter that is about 15-20 mm, such as about 17 mm. In exemplary embodiments, the fluid flow passage 66 is sized such that the pressure drop across the flow passage is less than about 5-10 psi, preferably about 5 psi or less. Minimizing the pressure drop from the first intake side 22 of the first pump cavity 20 to the second intake side 48 of the second pump cavity 46 enables the exemplary gear pump 10 to provide sufficient fluid pressure to the respective outlet ports 44, 64 of each pump section 14, 16 for suitable operation of the respective hydraulic functions that are connected to the gear pump 10.

The housing 12 may be any suitable housing made of any suitable material. In the illustrated embodiment, for example, the housing 12 is formed by two discrete cast-iron segments 12*a*, 12*b*, or end covers, that sandwich the divider 18 there between. As shown, the first end cover 12*a* defines the first pump cavity 20, and the second end cover 12*b* defines the second pump cavity 46. In the illustrated embodiment, both the first pump cavity 20 and the second pump cavity 46 have the same volume for providing the same fluid displacement from each pump section 14, 16 of the gear pump 10. Likewise, each of the first and second gear sets 26, 52 are substantially similar in size and configuration to provide the desired suction, transfer, and pressurization of the fluid in the respective pump cavities 20, 46, as discussed above. It is understood, however, that the size of the pump cavities 20, 46 and/or the size/configuration of the gear sets 26, 52 may be different from each other for providing a different amount of fluid displacement and/or pressurization in each section 14, 16 of the gear pump 10, as may be desirable for particular applications.

As shown in the illustrated embodiment, the first and second housing end covers 12*a*, 12*b* and the divider 18 may be secured together by a plurality of fasteners 68, such as bolts, that extend through corresponding receivers 69 (e.g., through-holes) in the second end cover 12*b*, corresponding receivers 70 (e.g., through-holes) in the divider 18, and corresponding receivers 71 (e.g., threaded bores) in the first end cover 12*a*. As shown, each housing segment 12*a*, 12*b* may include one or more seals 72*a*, 72*b*, such as elastomeric seals, that are disposed in respective seal grooves 74*a*, 74*b* of the respective housing segments 12*a*, 12*b* for fluidly sealing each of the first and second pump cavities 20, 46. In the illustrated embodiment, the respective seals 74*a*, 74*b* surround the respective pump cavities 20, 46, and are configured to sealingly engage against the divider 18 to provide such fluid seal.

The divider 18 may be any suitable divider that is made of any suitable material. In exemplary embodiments, the divider 18 may have a generally flat, plate-like form for separating the first pump section 14 from the second pump section 16, which enhances compactness of the pump design. As shown, the divider 18 has an outer periphery 78 that generally corresponds to the shape of the outer periphery of the housing end covers 12*a*, 12*b*. In exemplary embodiments, the divider 18 may be aligned with the respective housing end covers 12*a*, 12*b* via one or more dowel pins 79 that are inserted into corresponding holes 80*a*, 80*b* in the end covers 12*a*, 12*b*, and which provide alignment with the divider 18 via one or dimpled regions 82 at the periphery of the divider 18. It is understood that although the divider 18 is shown as being sandwiched between the first and second end covers 12*a*, 12*b*, the divider also could be contained within the housing 12.

In exemplary embodiments, the first drive gear 34 of the first gear set 26 is coaxially disposed on the same rotatable shaft 84 as the second drive gear 54 of the second gear set 52 for co-rotation therewith about the axis 38. In addition, the first idler gear 36 of the first gear set 26 is coaxially disposed on the same rotatable shaft 86 as the second idle gear 56 of the second gear set 52 for co-rotation therewith about the axis 39. In this manner, the rotational velocity of the first gear set 26 may be the same as the rotational velocity of the second gear set 52. It is understood, however, that providing different configurations between the gear sets 26, 52 (e.g., tooth configuration, gear width, or other sizing that would change displacement, etc.) may provide for different velocities of fluid flow through the respective pump cavities 20, 46 as may be desirable for certain applications, as would be understood by those having ordinary skill in the art.

Figure 13:
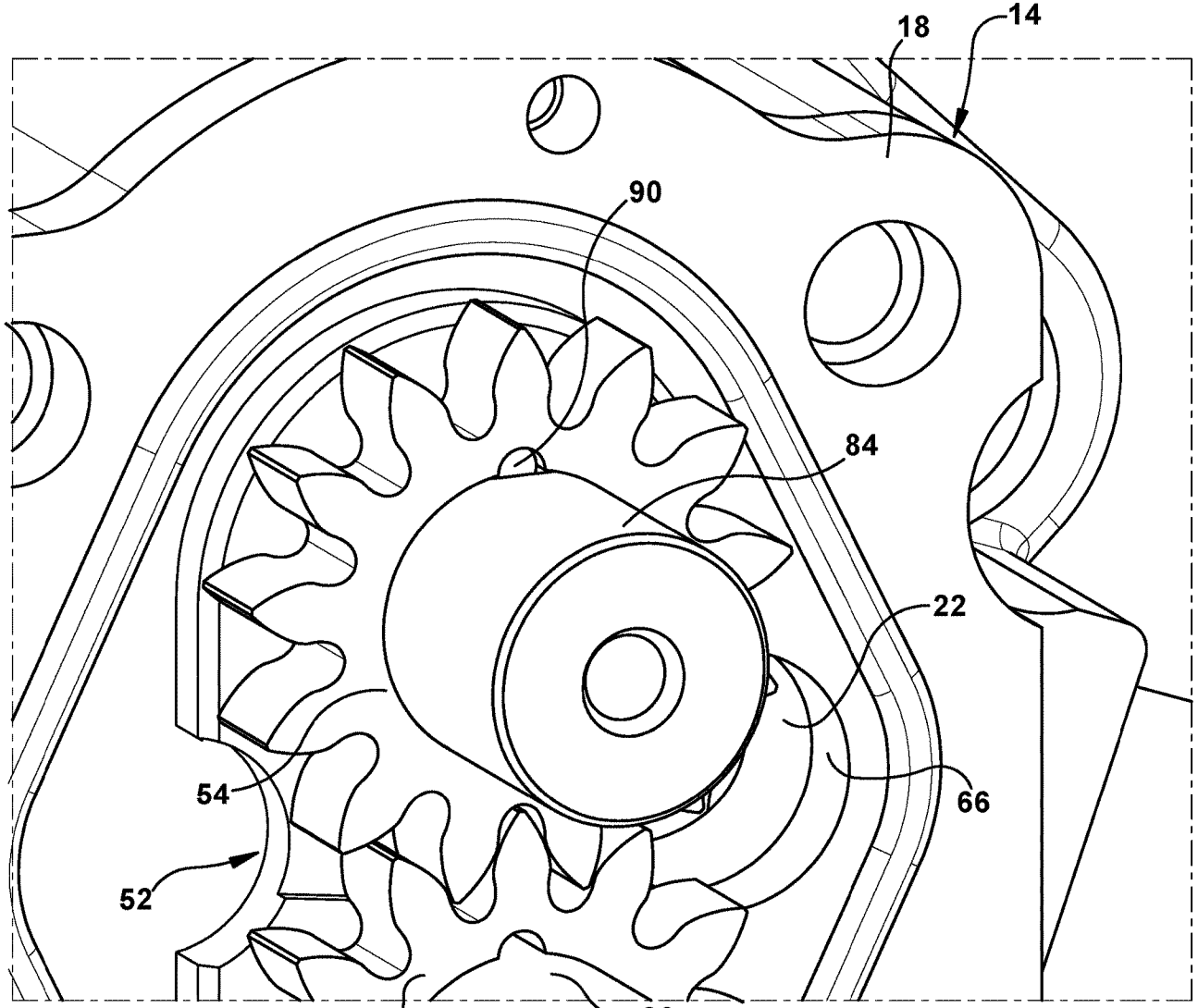
FIG. 13 is an enlarged perspective view of a portion of the second gear set shown in FIG. 12.
Figure 14:
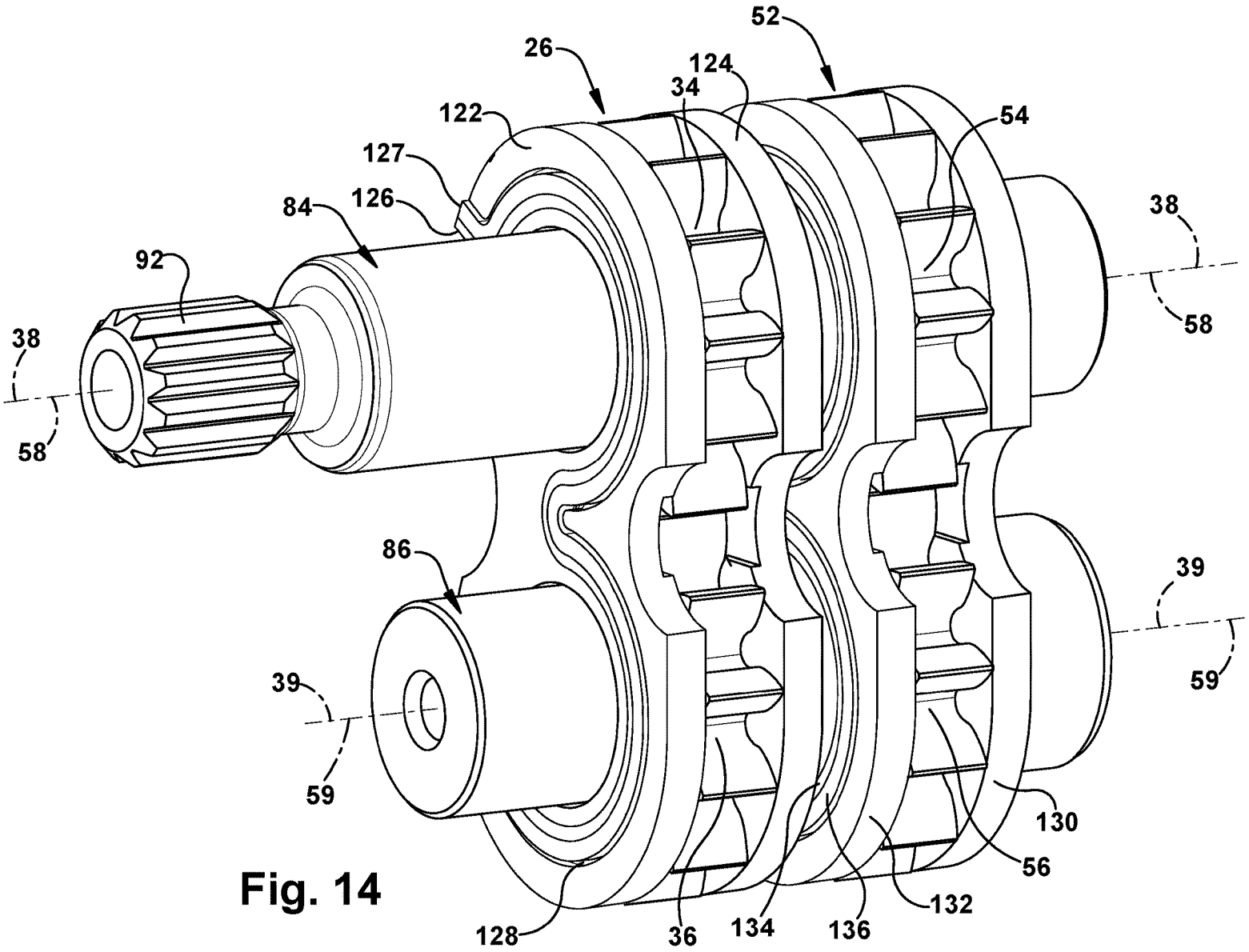
FIG. 14 is a perspective view of the exemplary first gear set and the exemplary second gear set shown disposed on respective shafts along with exemplary thrust plates, and shown without the divider interposed between the first and second gear sets.
Figure 15:
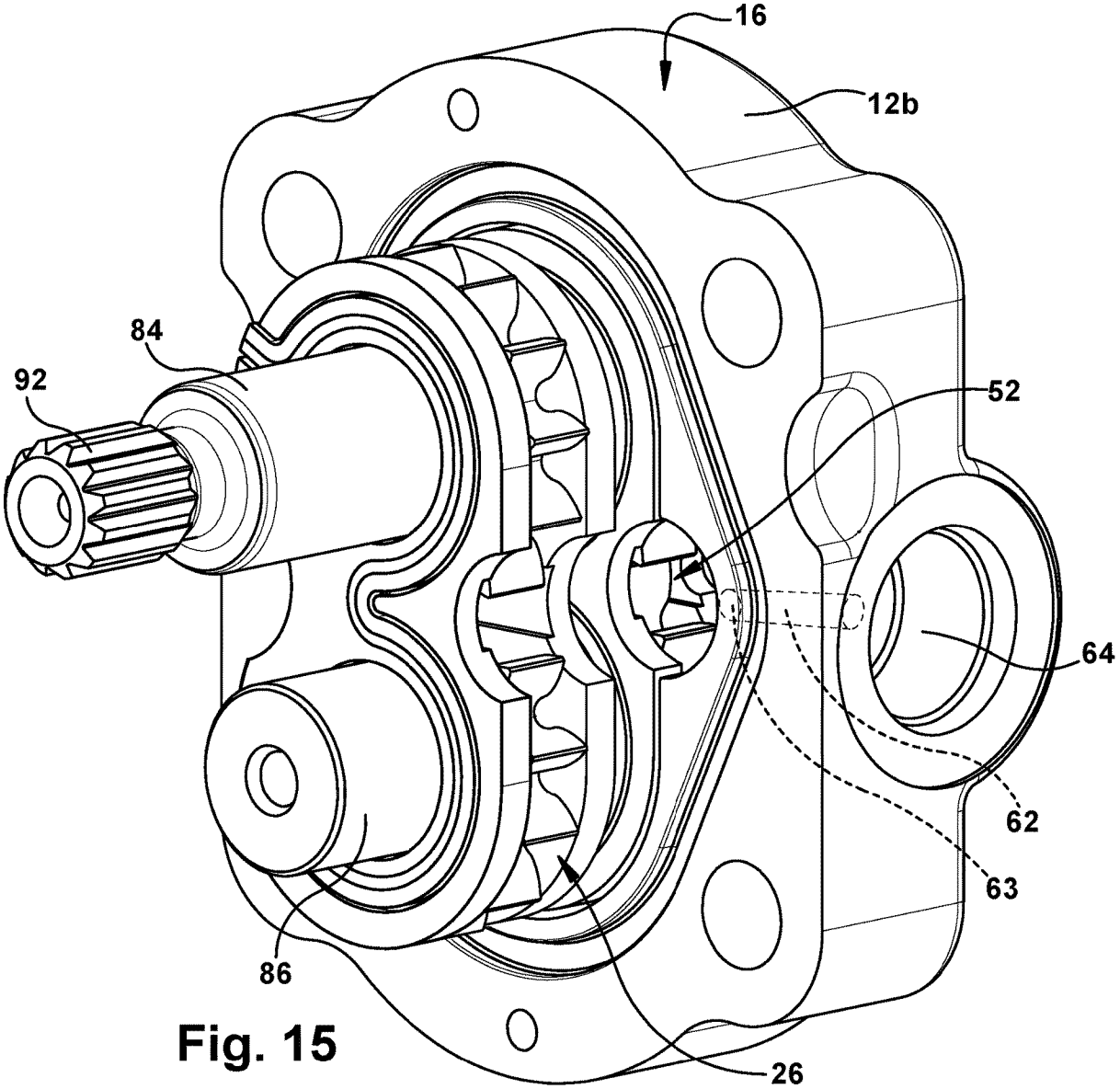
FIG. 15 is a front perspective view of an exemplary second pump section of the gear pump, which is shown with the first and second gear sets, shafts, and thrust plates of FIG. 14 installed therein, and shown without the divider installed.

In the illustrated embodiment, the shaft 84 having the first drive gear 34 and the second drive gear 54 is a drive shaft 84 which extends through a through-hole 88 in the divider 18. The drive shaft 84 rotatably supports the drive gears 34, 54 on opposite sides of the divider 18. In exemplary embodiments, the first drive gear 34 is integral with the journals or permanently fixed to the drive shaft 84. In exemplary embodiments, the second drive gear 54 is a so-called hubless or floating gear that is removably coupled to the drive shaft 84, such as via a key 90 or pin (as best shown in FIG. 13, for example). Such a configuration facilitates assembly of the gear pump 10 so as to enable the drive shaft 84 to extend through the divider 18 and thereafter couple the second drive gear 54 to the shaft 84. In exemplary embodiments, an axial end portion 92 of the drive shaft 84 has a splined configuration, in which the splined end portion 92 of the drive shaft 84 is configured to extend outwardly through a front opening 94 in the pump housing 12 to drivingly couple (directly or indirectly) with a motor or other suitable prime mover (illustrated in FIG. 16) to rotatably drive the drive shaft 84.

In the illustrated embodiment, the shaft 86 having the first idler gear 36 and the second idler gear 56 is an idler shaft 86 which extends through another through-hole 96 in the divider 18. The idler shaft 86 rotatably supports the idler gears 36, 56 on opposite sides of the divider 18. The idler shaft 86 is rotated via the meshing engagement of the respective idler gears 36, 56 with the respective drive gears 34, 54 that are driven by the drive shaft 84 such as via a prime mover. Similarly to the first and second drive gears 34, 54, in exemplary embodiments the first idler gear 36 is integral with or permanently fixed to the idler shaft 86, and the second idler gear 56 is a floating gear that is removably coupled to the idler shaft 86 such as via a key for facilitating assembly of the idler shaft 86 into the pump 10.

In exemplary embodiments, the drive shaft 84 has a first portion 98 on a first side of the shaft 84 that is journaled in a first bushing 100 which is disposed in the first pump section 14, and the drive shaft 84 has a second portion 102 on an opposite second side of the 84 shaft that is journaled in a second bushing 104 which is disposed in the second pump section 16. In the illustrated embodiment, the respective bushings 100, 102 are fit into respective bores 106, 108 on opposite sides of the housing 12 (e.g., first end cover 12*a* and second end cover 12*b*). Similarly to the drive shaft 84, the idler shaft 86 has a first portion 110 on a first side of the shaft 86 that is journaled in a third bushing 112 which disposed in the first pump section 14 (e.g., via another bore 114 in the first end cover 12*a*), and the idler shaft 86 has a second portion 116 on an opposite second side of the shaft 86 that is journaled in a fourth bushing 118 which is disposed in the second pump section 16 (e.g., via another bore 120 in the second end cover 12*b*). The respective bushings 100, 104, 112, 118 provide bearing interfaces for the respective rotating shafts 84, 86 which minimizes friction, wear and/or vibration during rotation of the shafts. It is understood that although bushings 100, 104, 112, 118 are shown as the bearings for the shafts 84, 86, other suitable bearings also may be utilized as would be understood by those having ordinary skill in the art.

In exemplary embodiments, the first gear set 26 and the second gear set 52 are located in close proximity to the divider 18 to further enhance the compactness of the gear pump design (as shown in the cross-sectional view of FIG. 8, for example). For example, in the illustrated embodiment, both the drive shaft 84 and the idler shaft 86 extend through the divider 18 without bushings or other suitable bearings being located between the divider 18 and the first gear set 26, and also without bushings or other suitable bearings being located between the divider 18 and the second gear set 52. More particularly, in the illustrated embodiment, the respective shafts 84, 86 are devoid of any bushings between the first and second gear sets 26, 52, such that the shafts 84, 86 are supported via bearing interfaces only at the portions (e.g., 98, 102, 112, 116) of the shafts 84, 86 that are axially outside of the gear sets 26, 52. As noted, such omission of the bushings between the respective gear sets 26, 52 and the divider 18 enhances the compactness of the design. It is understood, however, that in some embodiments the divider 18 may have bushings or other suitable bearings within the respective through-holes 88, 96 to further rotatably support the shafts 84, 86 as may be desirable for particular applications.

As shown in the illustrated embodiment, the exemplary gear pump 10 also includes one or more additional components that facilitate sealability, efficiency and/or other functionality of the design. For example, in the illustrated embodiment, the first pump section 14 includes an axially outward thrust plate 122 and an axially inward thrust plate 124 that are disposed on opposite sides of the first gear set 26. The respective thrust plates 122, 124 are configured to fit against the respective gears 34, 36 of the first gear set 26 to enhance efficiency of the pump 10. One or more seals, such as a hard seal 126 and a soft seal 127, are configured to fit in groove(s) in the axially outward thrust plate 122 to provide a fluid seal against first end cover 12*a*. Likewise, one or more seals, such as a hard seal 128 and a soft seal 129, are configured to fit in groove(s) in the axially inward thrust plate 124 to provide fluid seal against the divider 18. The second pump section 16 also includes the same components for the same functionality, including an axially outward thrust plate 130 and an axially inward thrust plate 132 that are disposed on opposite sides of the second gear set 52, and respective hard seals 134, 135 and soft seals 136, 137 that are respectively configured to provide fluid sealing against the divider 18 in the second pump section 16 and against the second end cover 12*b*.

Also as shown, the front end cover 12*a* may include a shaft seal 140 at the front opening 94 to prevent ingress of air into the first pump cavity 20 via the front opening 94. A seal ring 142 holds the shaft seal 140 in place. One or more additional seals 146 also may be provided radially outwardly of the front opening 94 to provide a fluid seal with a portion of the work machine, such as with a transmission casing or motor housing of the work machine, as discussed in further detail below.

Figure 16:
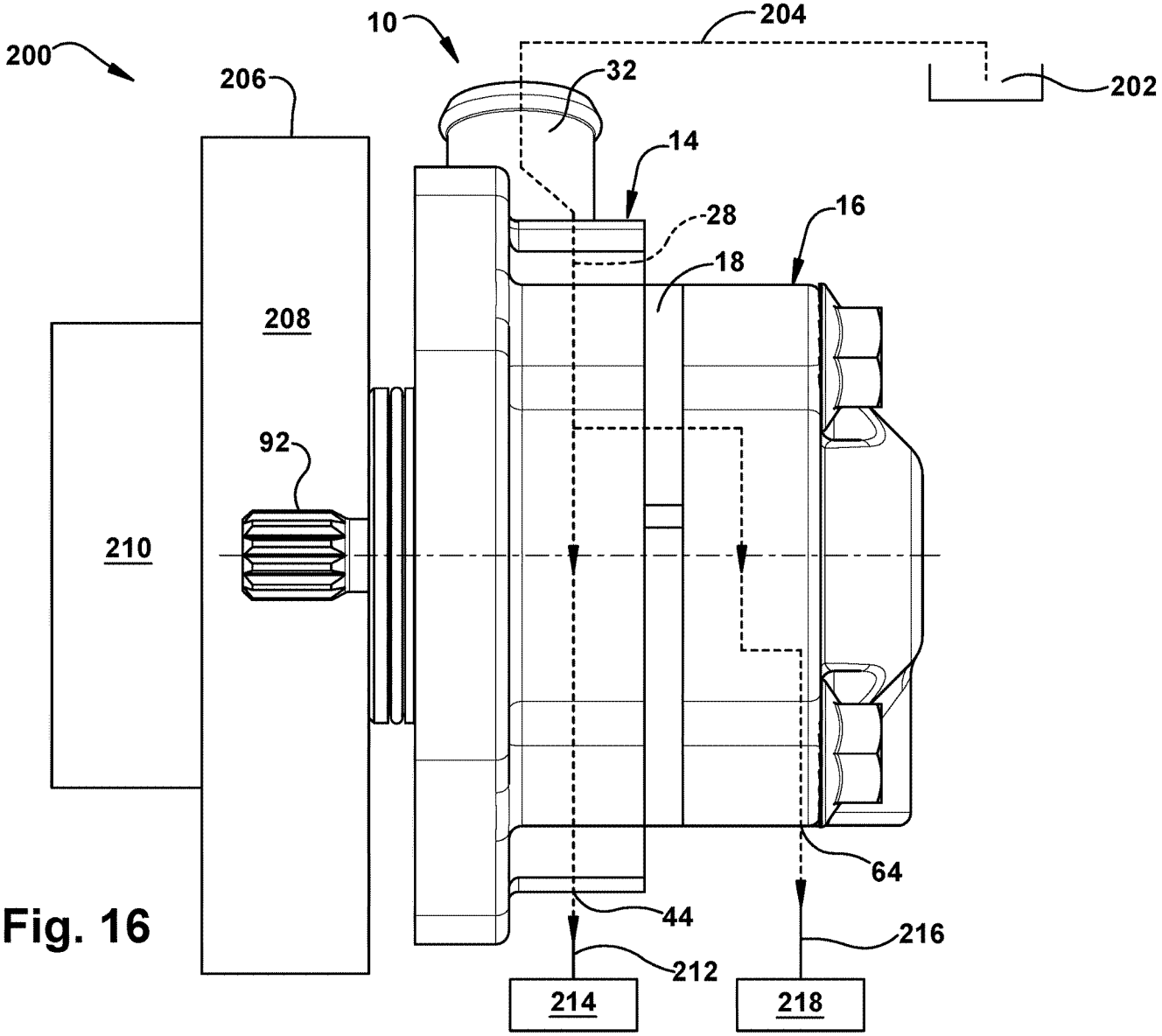
FIG. 16 is an exemplary fluid circuit diagram for an exemplary work machine having the gear pump installed therein.

Referring to FIG. 16, an exemplary fluid circuit 200 for a work machine having the exemplary gear pump 10 is shown. As shown, the fluid circuit 200 includes a source of fluid 202, such as a reservoir, which is fluidly connected to the inlet 28 of the gear pump 10 via an inlet conduit 204. As described above, with further reference to FIGS. 1-15, the gear pump 10 may be coupled to (and fluidly sealed against) a transmission casing 206 of the work machine such that the drive shaft of the gear pump is driving coupled (such as via the splined end portion 92 via a transmission 208) to a prime mover 210, such as a motor. The prime mover 210 rotates the drive shaft 84 which rotates the first and second drive gears 34, 54, which thereby rotate the respective first and second idler gears 36, 56 via the meshing engagement of the respective gear sets 26, 52. As discussed above, the respective gear sets 26, 52 are arranged within the respective first and second pump cavities 20, 46 to create suction which draws the fluid from the fluid source 202 into the first intake side 22 of the first pump cavity 20, and which draws the fluid from the first intake side 22 into the second intake side 48 of the second pump cavity 46 via the flow passage 66 in the divider 18.

As discussed above, the respective gear teeth of the respective first and second gear sets 26, 52 convey the fluid to the discharge sides 24, 50 of each pump cavity 20, 46, and the meshing engagement of the respective gear teeth increases the fluid pressure on the discharge sides 24, 50, which forces the pressurized fluid out of the respective cavities 20, 46 via the separate first and second outlet ports 44, 64. As described above, although the divider 18 is configured to allow flow sharing between the respective intake sides 22, 48 of the first and second pump cavities 20, 46, the divider 18 also is configured to isolate the conveyance of the fluid and the pressurization of the fluid within each pump cavity 20, 46, thereby providing independent pressurization and discharge of the fluid from each pump cavity 20, 46. This enables the gear pump 10 to operate efficiently, especially if there is a large difference in the loading between the two separate work functions.

In exemplary embodiments, the work machine may be a work vehicle, such as an agricultural or industrial vehicle, for example. In exemplary embodiments, the first outlet port 44 may be fluidly connected via a first fluid conduit 212 to an actuator or the like to provide a hydraulically-operable function, such as moving an implement 214 (e.g., lifting, tilting or generally moving a backhoe, bucket, loader, stabilizer legs, or the like). In exemplary embodiments, the second outlet port 64 may be fluidly connected via a second fluid conduit 216 to another actuator or the like to provide another independent hydraulically-operable function, such as steering the vehicle, or moving another implement 218. It understood that the exemplary gear pump 10 and the exemplary fluid circuit 200 may be applicable to other hydraulic systems for other applications where desirable.

An exemplary dual-section gear pump 10 that enhances compactness of the design while providing good efficiency at a competitive cost has been described herein. More particularly, the gear pump provides at least two pump sections separated by a divider, in which the two pump sections may share a common intake flow across the divider, and also provides respective gear sets in each pump section for providing independent pressurization of the fluid in each pump section for discharge of the pressurized fluid via separate outlets. The gear pump is configured to provide suitable sealing between each pump section and support of the respective gear sets in each pump section while enhancing compactness, and while also enabling the pump to perform efficiently, especially when there is a large difference in loading between pump sections.

According to an aspect of the invention, a gear pump includes: a first pump section, a second pump section, and a divider that separates the first pump section from the second pump section; the first pump section having: a first pump cavity having a first intake side and a first discharge side, an inlet fluidly connected to the first intake side of the first pump cavity for ingress of fluid into the first pump cavity, a first gear set disposed in the first pump cavity and separating the first intake side from the first discharge side, the first gear set including a first drive gear and a first idler gear that are rotatable about respective axes, wherein the first drive gear and the first idler gear are configured to be in meshing engagement with each other such that fluid is transferred around the outside of the first gear set from the first intake side to the first discharge side when in use; and a first outlet in fluid communication with the first discharge side of the first pump cavity for enabling discharge of the fluid from the first pump cavity; the second pump section having: a second pump cavity having a second intake side and a second discharge side, a second gear set disposed in the second pump cavity and separating the second intake side from second first discharge side, the second gear set including a second drive gear and a second idler gear that are rotatable about respective axes, wherein the second drive gear and the second idler gear are configured to be in meshing engagement with each other such that fluid is transferred around the outside of the second gear set from the second intake side to the second discharge side when in use; and a second outlet in fluid communication with the second discharge side of the second pump cavity for enabling discharge of the fluid from the second pump cavity; wherein the divider includes a fluid flow passage that fluidly connects the first pump cavity with the second pump cavity for supplying fluid to the second intake side of the second pump cavity.

Embodiments of the invention may include one or more of the following additional features, separately or in any combination.

In some embodiments, the fluid flow passage of the divider fluidly connects the first intake side of the first pump cavity with the second intake side of the second pump cavity.

In some embodiments, the fluid flow passage is sized to minimize pressure drop across the fluid flow passage as fluid is supplied from the first pump cavity to the second pump cavity.

In some embodiments, the first pump cavity and the second pump cavity are configured to provide the same displacement of fluid.

In some embodiments, the first drive gear is coaxial with the second drive gear.

In some embodiments, the first idler gear is coaxial with the second idler gear.

In some embodiments, the first drive gear and the second drive gear are coaxially disposed on a drive shaft, and wherein the first idler gear and the second idler gear are coaxially disposed on an idler shaft.

In some embodiments, the first gear set and the second gear set are configured to provide the same discharge velocity of fluid.

In some embodiments, the drive shaft extends through the divider, the drive shaft having a first side journaled in a first bushing disposed in the first pump section, and the drive shaft having an opposite second side journaled in a second bushing disposed in the second pump section.

In some embodiments, the idler shaft extends through the divider, the idler shaft having a first side journaled in a third bushing disposed in the first pump section, and the drive shaft having an opposite second side journaled in a fourth bushing disposed in the second pump section.

In some embodiments, the pump is devoid bushings between the first gear set and the divider, and is devoid of bushings between the second gear set and the divider.

In some embodiments, the first drive gear is permanently fixed to and/or integral with the drive shaft, and wherein the second drive gear is removably coupled to the drive shaft.

In some embodiments, the first idler gear is permanently fixed to and/or integral with the idler shaft, and wherein the second idler gear is removably coupled to the idler shaft.

In some embodiments, the first pump section and the second pump section together define at least a portion of a pump housing that contains the first and second gear sets.

In some embodiments, a portion of the drive shaft extends outwardly of the housing for being drivingly coupled to a motor.

In some embodiments, the portion of the drive shaft that extends outwardly of the housing has a splined configuration.

In some embodiments, the portion of the drive shaft that extends outwardly of the housing extends outwardly from the first pump section.

In some embodiments, the pump housing is a segmented housing having a first end cover that defines the first pump cavity, and a second pump end cover that defines the second pump cavity.

In some embodiments, the first pump end cover and the second pump end cover sandwich the divider therebetween.

In some embodiments, the gear pump further includes a first thrust plate disposed between the first gear set and the first end cover, the first thrust plate having one or more seals that sealingly engage against the first end cover.

In some embodiments, the gear pump further includes a second thrust plate disposed between the first gear set and the divider, the second thrust plate having one or more seals that sealingly engage against the divider.

In some embodiments, the gear pump further includes a third thrust plate disposed between the second gear set and the second end cover, the third thrust plate having one or more seals that sealingly engage against the second end cover.

In some embodiments, the gear pump further includes a fourth thrust plate disposed between the second gear set and the divider, the fourth thrust plate having one or more seals that sealingly engage against the divider.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A gear pump comprising: a first pump section, a second pump section, and a divider that separates the first pump section from the second pump section;

the first pump section having:

a first pump cavity having a first intake side and a first discharge side, an inlet fluidly connected to the first intake side of the first pump cavity for ingress of fluid into the first pump cavity, a first gear set disposed in the first pump cavity and separating the first intake side from the first discharge side, the first gear set including a first drive gear and a first idler gear that are rotatable about respective axes, wherein the first drive gear and the first idler gear are configured to be in meshing engagement with each other such that fluid is transferred around the outside of the first gear set from the first intake side to the first discharge side when in use; and a first outlet in fluid communication with the first discharge side of the first pump cavity for enabling discharge of the fluid from the first pump cavity;

the second pump section having:

a second pump cavity having a second intake side and a second discharge side, a second gear set disposed in the second pump cavity and separating the second intake side from the second discharge side, the second gear set including a second drive gear and a second idler gear that are rotatable about respective axes, wherein the second drive gear and the second idler gear are configured to be in meshing engagement with each other such that fluid is transferred around the outside of the second gear set from the second intake side to the second discharge side when in use; and a second outlet in fluid communication with the second discharge side of the second pump cavity for enabling discharge of the fluid from the second pump cavity;

wherein the divider includes a fluid flow passage that fluidly connects the first pump cavity with the second pump cavity for supplying fluid to the second intake side of the second pump cavity, wherein the first drive gear and the second drive gear are coaxially disposed on a drive shaft, wherein the first idler gear and the second idler gear are coaxially disposed on an idler shaft, wherein the first pump section and the second pump section together define at least a portion of a pump housing that contains the first and second gear sets, wherein a portion of the drive shaft extends outwardly of the housing for being drivingly coupled to a motor, wherein the pump housing is a segmented housing having a first end cover that defines the first pump cavity, and a second end cover that defines the second pump cavity, wherein the gear pump further includes a first thrust plate disposed between the first gear set and the first end cover, the first thrust plate having one or more seals that sealingly engage against the first end cover, and wherein the gear pump further includes a second thrust plate disposed between the first gear set and the divider, the second thrust plate having one or more seals that sealingly engage against the divider.

2. The gear pump according to claim 1, wherein the gear pump further includes a third thrust plate disposed between the second gear set and the second end cover, the third thrust plate having one or more seals that sealingly engage against the second end cover; and wherein the gear pump further includes a fourth thrust plate disposed between the second gear set and the divider, the fourth thrust plate having one or more seals that sealingly engage against the divider.

3. A gear pump comprising: a first pump section, a second pump section, and a divider that separates the first pump section from the second pump section;

the first pump section having:

a first pump cavity having a first intake side and a first discharge side, an inlet fluidly connected to the first intake side of the first pump cavity for ingress of fluid into the first pump cavity, a first gear set disposed in the first pump cavity and separating the first intake side from the first discharge side, the first gear set including a first drive gear and a first idler gear that are rotatable about respective axes, wherein the first drive gear and the first idler gear are configured to be in meshing engagement with each other such that fluid is transferred around the outside of the first gear set from the first intake side to the first discharge side when in use; and a first outlet in fluid communication with the first discharge side of the first pump cavity for enabling discharge of the fluid from the first pump cavity;

the second pump section having:

a second pump cavity having a second intake side and a second discharge side, a second gear set disposed in the second pump cavity and separating the second intake side from the second discharge side, the second gear set including a second drive gear and a second idler gear that are rotatable about respective axes, wherein the second drive gear and the second idler gear are configured to be in meshing engagement with each other such that fluid is transferred around the outside of the second gear set from the second intake side to the second discharge side when in use; and a second outlet in fluid communication with the second discharge side of the second pump cavity for enabling discharge of the fluid from the second pump cavity;

wherein the divider includes a fluid flow passage that fluidly connects the first pump cavity with the second pump cavity for supplying fluid to the second intake side of the second pump cavity, and wherein the gear pump further includes a first thrust plate disposed between the first gear set and a first side of the divider, and a second thrust plate disposed between the second gear set and a second side of the divider.

4. The gear pump according to claim 3, wherein:

the first pump section forms a first pump housing segment, the second pump section forms a second pump housing segment that is discrete from the first pump housing segment, and the divider is discrete from both the first and second pump housing segments, the divider being sandwiched between respective first and second interface surfaces of the first and second pump housing segments such that the divider separates the first pump section from the second pump section;

the first pump cavity is recessed relative to the first interface surface of the first pump housing segment; and the second pump cavity is recessed relative to the second interface surface of the second pump housing segment.

5. The gear pump according to claim 3, wherein the fluid flow passage of the divider fluidly connects the first intake side of the first pump cavity with the second intake side of the second pump cavity.

6. The gear pump according to claim 3, wherein the fluid flow passage is sized to minimize pressure drop across the fluid flow passage as fluid is supplied from the first pump cavity to the second pump cavity.

7. The gear pump according to claim 3, wherein the first pump cavity and the second pump cavity are configured to provide the same displacement of fluid.

8. The gear pump according to claim 3, wherein the first drive gear is coaxial with the second drive gear.

9. The gear pump according to claim 3, wherein the first idler gear is coaxial with the second idler gear.

10. The gear pump according to claim 3, wherein the first drive gear and the second drive gear are coaxially disposed on a drive shaft, and wherein the first idler gear and the second idler gear are coaxially disposed on an idler shaft.

11. The gear pump according to claim 10, wherein the first gear set and the second gear set are configured to provide the same discharge velocity of fluid.

12. The gear pump according to claim 10, wherein the drive shaft extends through the divider, the drive shaft having a first side journaled in a first bushing disposed in the first pump housing segment, and the drive shaft having an opposite second side journaled in a second bushing disposed in the second pump housing segment.

13. The gear pump according to claim 12, wherein the idler shaft extends through the divider, the idler shaft having a first side journaled in a third bushing disposed in the first pump housing segment, and the idler shaft having an opposite second side journaled in a fourth bushing disposed in the second pump housing segment.

14. The gear pump according to claim 13, wherein the pump is devoid bushings between the first gear set and the divider, and is devoid of bushings between the second gear set and the divider.

15. The gear pump according to claim 10, wherein the first drive gear is permanently fixed to and/or integral with the drive shaft, and wherein the second drive gear is removably coupled to the drive shaft.

16. The gear pump according to claim 15, wherein the first idler gear is permanently fixed to and/or integral with the idler shaft, and wherein the second idler gear is removably coupled to the idler shaft.

17. The gear pump according to claim 10, wherein the first pump housing segment and the second pump housing segment together define at least a portion of an overall pump housing that contains the first and second gear sets; and wherein a portion of the drive shaft extends outwardly from a part of the overall pump housing for being drivingly coupled to a motor.

18. The gear pump according to claim 17, wherein the portion of the drive shaft that extends outwardly from the part of the overall pump housing has a splined configuration.

19. The gear pump according to claim 17, wherein the portion of the drive shaft extends outwardly from the first pump housing segment.

20. The gear pump according to claim 17, wherein the first pump housing segment forms a first end cover that defines the first pump cavity as a first blind gear bore, and the second pump housing segment forms a second end cover that defines the second pump cavity as a second blind gear bore.

* * * * *